US006669034B2

(12) United States Patent
Diedrichsen

(10) Patent No.: US 6,669,034 B2
(45) Date of Patent: Dec. 30, 2003

(54) CURTAIN ROD

(75) Inventor: Manfred Diedrichsen, Bielefeld (DE)

(73) Assignee: Manfred Diedrichsen & Co. (DE)

( * ) Notice: Subject to any disclaimer, the term of this patent is extended or adjusted under 35 U.S.C. 154(b) by 0 days.

(21) Appl. No.: 10/130,688

(22) PCT Filed: Sep. 14, 2001

(86) PCT No.: PCT/EP01/10612

§ 371 (c)(1),
(2), (4) Date: May 20, 2002

(87) PCT Pub. No.: WO02/24042

PCT Pub. Date: Mar. 28, 2002

(65) Prior Publication Data

US 2002/0179554 A1 Dec. 5, 2002

(51) Int. Cl.[7] ..... A47F 5/00
(52) U.S. Cl. ..... 211/105.1; 211/123; 248/151
(58) Field of Search ..... 211/123, 105.1, 211/105.4; 248/151

(56) References Cited

U.S. PATENT DOCUMENTS 1,500,049 A * 7/1924 Brooks
2,399,001 A * 4/1946 Chilton ..... 211/123
5,011,030 A * 4/1991 Alaurent ..... 211/105.6
5,110,079 A * 5/1992 Evenson et al. ..... 211/105.1 X

FOREIGN PATENT DOCUMENTS

| | | |
|---|---|---|
| DE | 9101331 | 4/1991 |
| DE | 9736565 | 2/1999 |
| DE | 9900280 | 3/1999 |
| DE | 9922379 | 3/2000 |
| DE | 0000222 | 7/2000 |
| FR | 1024461 | 4/1953 |
| GB | 583740 | 11/1944 |
| LU | 38393 | 4/1960 |

* cited by examiner

*Primary Examiner*—Robert W. Gibson, Jr.
(74) *Attorney, Agent, or Firm*—Bourque & Associates, P.A

(57) ABSTRACT

A wardrobe rod with two brackets includes a tensioning device for tensioning the wardrobe rod along its longitudinal direction. The tensioning device includes a tension member that longitudinally transfixes the wardrobe rod formed as a tube. Its centerline extends beyond its ends displaced with respect to the centerline of the wardrobe rod, and lies at least in the displaced area on contact surfaces of an insert that is supported by the inner wall area of the wardrobe rod opposite the tension member.

14 Claims, 5 Drawing Sheets

CURTAIN ROD

TECHNICAL FIELD

The invention relates to wardrobe rods.

BACKGROUND INFORMATION

The problem with wardrobe rods is that they sag, both from the influence of their own weight and from the influence of clothing hung on them. In a known wardrobe rod of the type disclosed in DE 197 36 565 A1, one attempts to compensate the bending of the wardrobe rod so that the entire wardrobe rod is tensioned by a threaded piece that operates in conjunction with a counter-threaded area along the longitudinal direction of the wardrobe rod. The tension created by rotating the thread and counter-thread must be transferred to the walls via the brackets. By tensioning the wardrobe rod, only a part of the bending caused by its own weight or load weight can be compensated because the tensioning forces at the end of the tensioning process increase without limit. The ability to be tensioned therefore depends on the stability of the anchoring of the brackets to the wall.

SUMMARY OF THE INVENTION

Based on this state of the art, it is the task of this invention to design a wardrobe rod with a tensioning device that allows mounting even without extremely strong forces that may no longer be controlled in that the wardrobe rod maintains as straight a line as possible in mounted and in loaded condition. The sag of the wardrobe rod must be practically completely capable of being compensated by means of the tensioning device.

In the wardrobe rod based on the invention, the tube is transfixed longitudinally by a tension member whose centerline beyond its ends extends displaced with respect to the centerline of the wardrobe rod in non-loaded condition. The tension member is positioned at least partially in the displaced area at the bearing surfaces of an insert that rests against the inner wall of the wardrobe rod at the end opposite the sliding member. Such an arrangement results in the situation that the sag may not only be compensated by tensioning the sliding member, but may also be overcompensated. A wardrobe rod formed in such manner and sagging from its own weight and/or load weight is displaced upwards by the tensioning of the tension member below in the central area. During this, the tension member may be tensioned to a degree beyond the previous bearable tension forces, so that the central area of the horizontally-installed wardrobe rod actually moves above the centerline between the two brackets.

The centerline of the tension member is preferably positioned in the direction opposite the centerline of the wardrobe rod through which the wardrobe rod sags under the influence of its own weight and/or load.

The tension member is formed to be suitably flexible. By virtue of the flexible form of the tension member, the wardrobe rod based on the invention may be simple, light, and nevertheless stable.

Other advantageous embodiments of the invention result from the sub-claims.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1A:
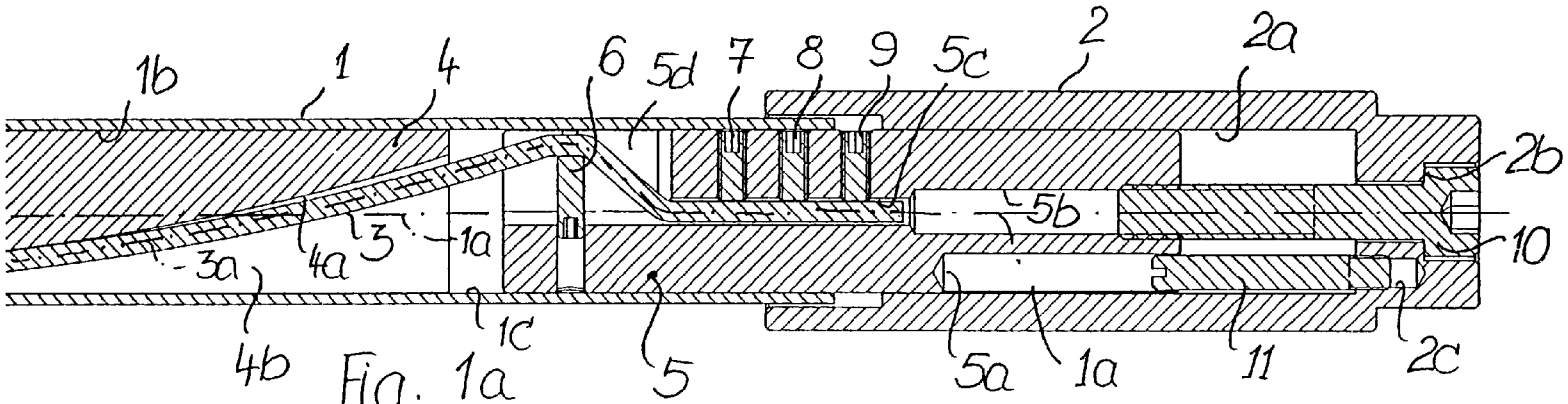
FIG. 1*a* is a longitudinal sectional view of the right end of a first embodiment of a wardrobe rod and a receiver of a right bracket.

In the various illustrations, identical or corresponding parts are identified using consistent reference numerals. They are distinguished from one another as necessary using apostrophes.

For the embodiment shown in FIG. 1, the tension applied to a tension member 3 is transferred to the wall to which the bracket is attached by means of the receiver 2 and the other parts of the bracket via securing screws 12. In this embodiment, the bracket serves as the abutment for the tension member or pre-stressing element.

Figure 3A:
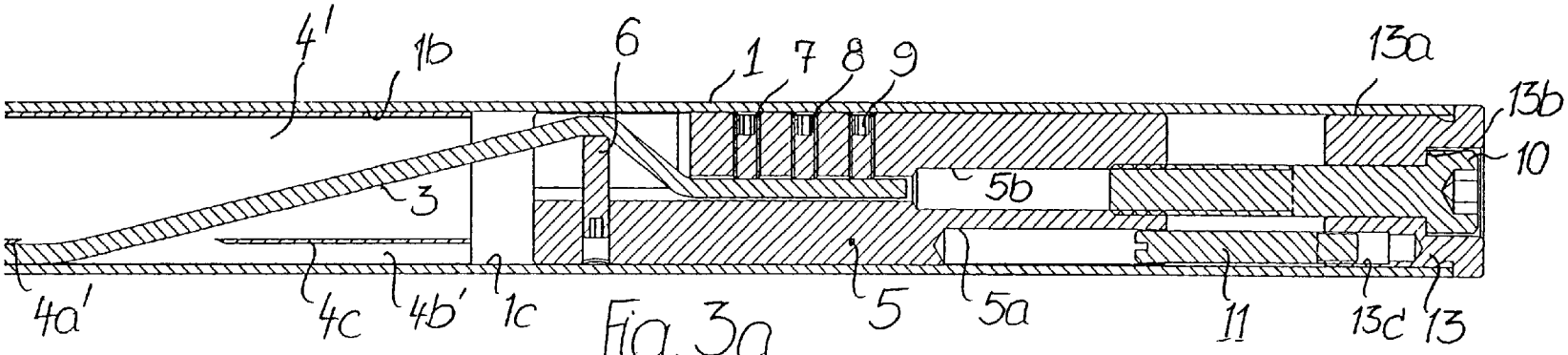
FIG. 3*a* is a longitudinal sectional view of a second embodiment of a wardrobe rod without a bracket.
Figure 3B:
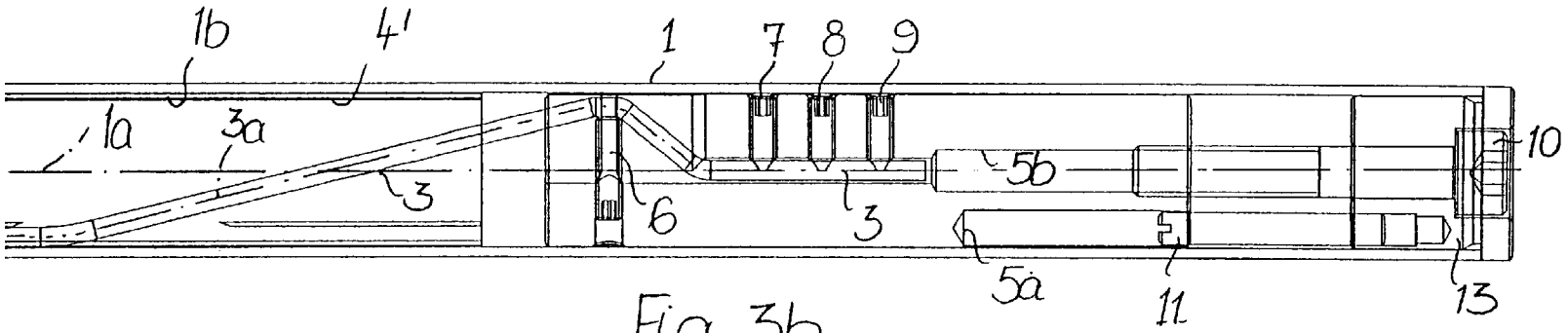
FIG. 3*b* is a transparent view of FIG. 3*a;*
Figure 4A:
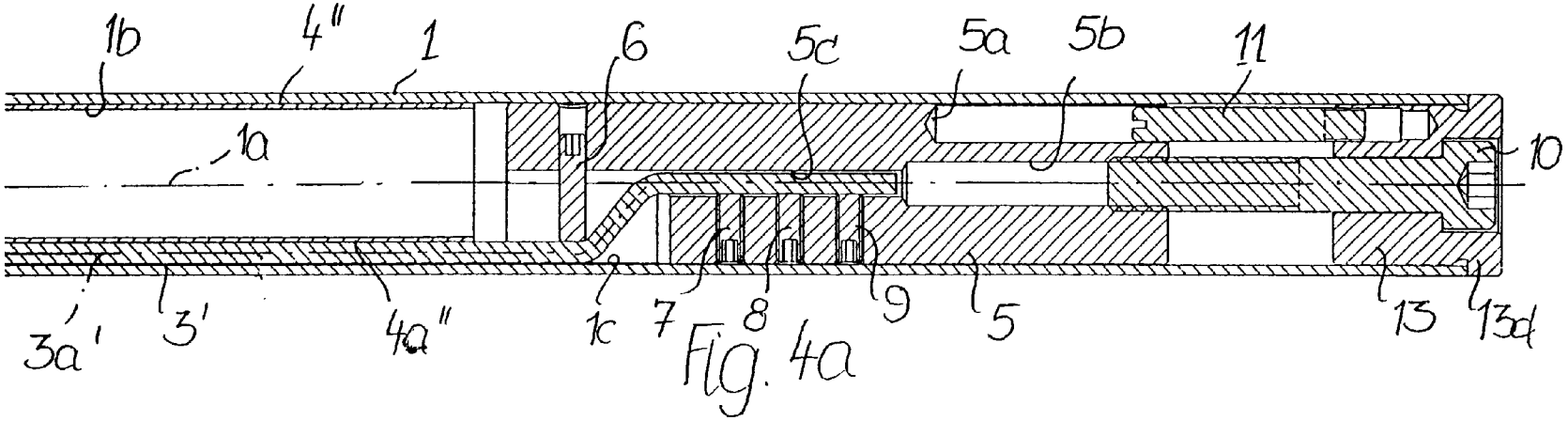
FIG. 4*a* is a sectional view of another embodiment of a wardrobe rod without a bracket.
Figure 4B:
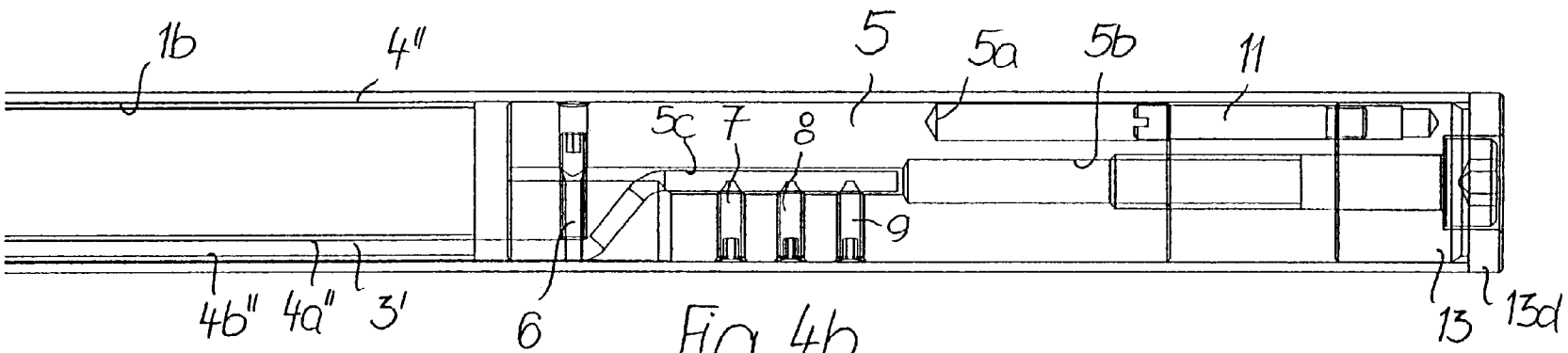
FIG. 4*b* is a transparent view of the embodiment of FIG. 4*a;*

For the embodiment shown in FIGS. 3 and 4, the end of the wardrobe rod 1 itself serves as the abutment for the tensioning device by means of which the tension member 3 or 3' is tensioned.

Figure 1B:
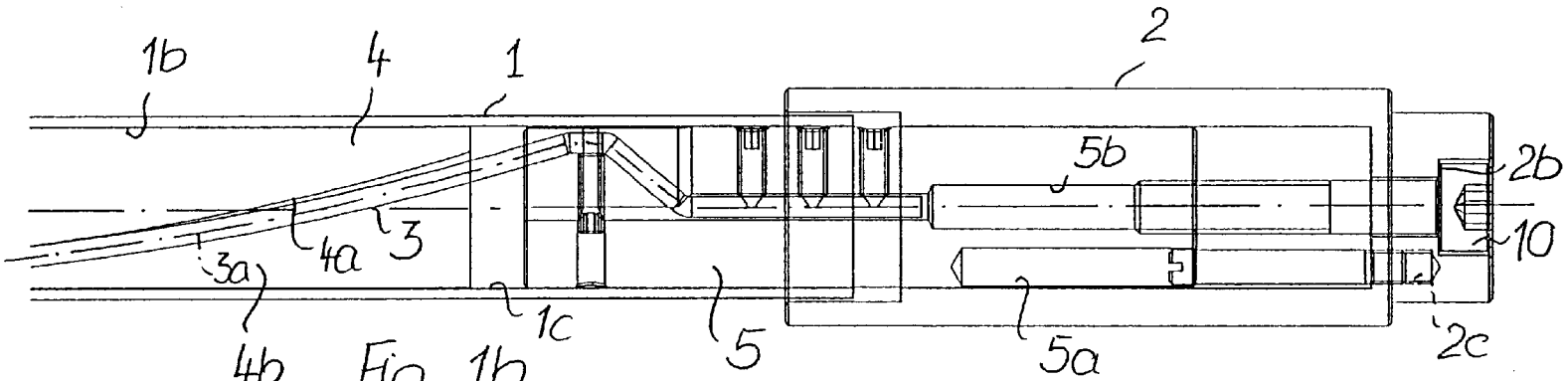
FIG. 1*b* is a cutaway view of the embodiment of FIG. 1*a* with bracket in a fully transparent view.
Figure 2:
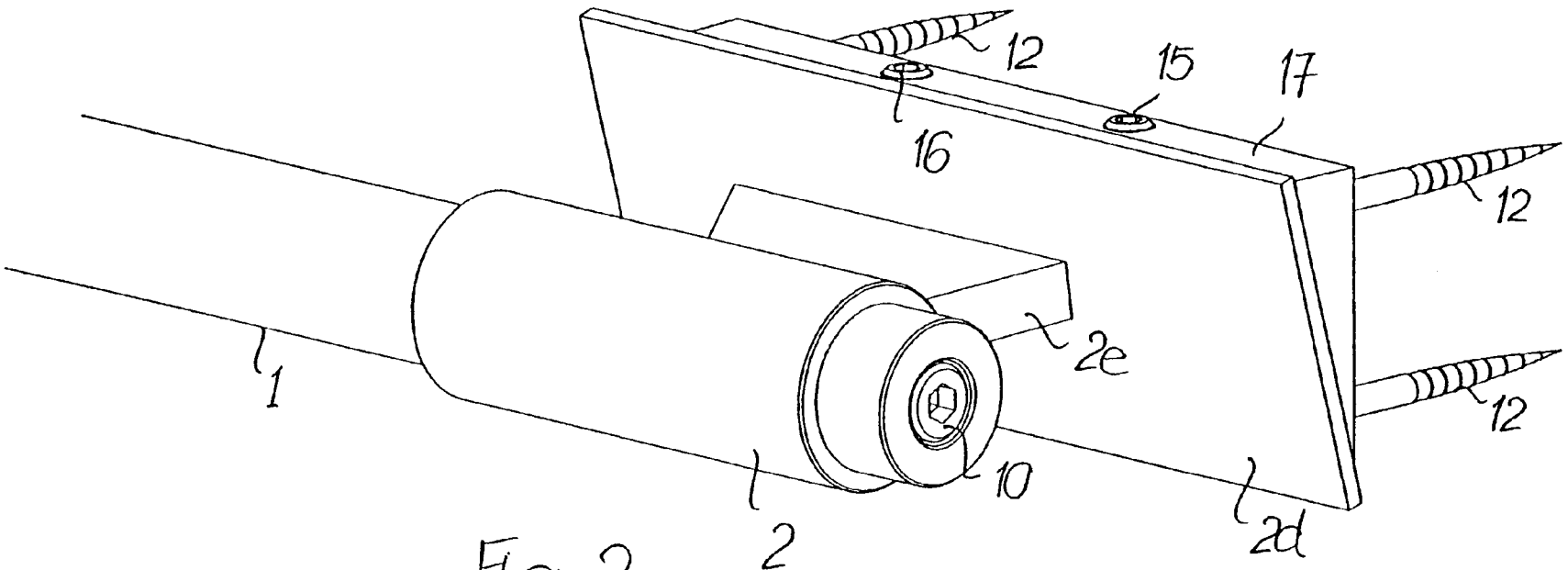
FIG. 2 is a perspective view of the wardrobe rod and bracket of FIGS. 1*a* and 1*b* with the bracket fully shown.

Regarding the embodiment of FIGS. 1 and 2:

A wardrobe rod 1 is formed as a tube. An insert piece 4 is inserted in the center of the tube 1 which is surrounded and contacted by an inner wall 1*c* of the tube 1. The piece 4 is essentially one solid piece that includes a continuous longitudinal slot 4*b*. The width of the longitudinal slot 4*b* corresponds to the diameter of a tension member 3 formed as a cord. The height of the slot 4*b* changes along the length of the insert piece 4. In the center area (not shown) of the insert piece 4, which coincides with the central area of the wardrobe rod 1, the longitudinal slot 4*b* is shortest, and at both ends of the insert piece 4 (of which only the right end is shown in FIGS. 1*a* and 1*b*), the longitudinal slot is tallest. The base of the longitudinal slot 4*b* forms a contact surface for the tension member 3. As seen from the end areas, the base of the longitudinal slot 4*b* serving as a contact surface 4*a* extends almost the entire length of the insert piece 4 below the longitudinal centerline 1*a* of the wardrobe rod 1.

The tension member 3, which might be a metal cable, for example, extends into a tension element 5. The route is determined by an adjusting screw 6 by means of which the tension element 3 is guided into a slot 5*d* whose width is approximately the same as the width of the tension member 3. The tension member 3 is fed downward behind the adjustment screw 6, namely into a central hole 5*c* coaxial with the axis 1*a* of both the wardrobe rod 1 and of the tension element 5. The end of the tension member 3 is attached in the central hole 5*c* of the tension element 5 by means of headless screws 7, 8, and 9 pointing radially inwards.

The tension element 5 includes a cylindrical outer wall with a diameter that matches the diameter of the inner wall 1*c* of the wardrobe rod 1, as well as the diameter of the inner wall 2*a* of the receiver 2 of the bracket.

The tension element 5 may be displaced longitudinally both within the wardrobe rod 1 and the receiver 2.

The tension element 5 is hindered by a twist about the central axis 1*a* because it possesses an eccentric hole 5*a* into which a guide pin 11 engages. The guide pin 11 is threaded into a front-side thread 2*a* of the receiver 2.

The tension element 5 includes a threaded hole 5*b* connected to the central hole 5*c* that receives the end of the tension member 3. The threaded shaft of a screw 10 whose head includes an internal six-sided wrench surface engages in this threaded hole 5*b*. The head of the screw 10 rests on a shoulder 2*b* of the front area of the receiver 2. When the screw 10 is turned, the tension element 5 moves left or right along the axis 1*a*, depending on the rotation direction.

The receiver 2 of the bracket (see FIG. 2) forms a cover plate 2*d* and a transition area 2*e*. The transition area 2*e*, which is attached to the cover plate 2*d* is attached to a base plate 17 by screws 15 and 16. The base plate 17 is attached by a total of four attaching screws 12 that are in turn screwed into fixed mounting anchors in the wall.

In the embodiment of FIG. 3, in contrast to the embodiment of FIG. 1, both the insert piece 4' and the abutment of the screw 10 are altered. The screw 10 lies with its head on a shoulder of a stop 13 resting on the front surface of the wardrobe rod 1. The stop 13 is recessed, and in such a manner that its connection 13*a* is centered on the inner wall 1*c* of the wardrobe rod 1. The guide pin 11 is threaded into the threaded hole 13*c*, and prevents rotation of the tension element 5 when it is tensioned by means of the screw 10 also in this embodiment example.

The insert piece 4' in this embodiment is formed essentially as a tube fitting into the inner diameter of the wardrobe rod 1. However, the tube includes on its underside a channel 4*b*' opening toward the bottom whose cross-section corresponds to the outer cross-section of the tension member 3, and that extends over the entire length of the insert piece 4'. The channel base 4*c* in the illustrated area is interrupted, and serves as a contact surface 4*a*' for the tension member 3 in the visible left area of FIG. 3.

The embodiment of FIG. 4 essentially corresponds to the embodiment of FIG. 3 to the extent that the tension member 3' in FIG. 4 is fed through the entire length of an uninterrupted longitudinal slot 4*b*" of the insert piece 4". The continuous contact surface 4*a*" for the tension member 3', whose centerline is identified by 3*a*', is located on the upper side of the slot 4*b*".

For the example of FIG. 4, the tension member 3' passes over the screw 6, and from there rises to the central hole 5*c*, in which the end of the tension member 3' is fixed by means of clamping screws 7, 8, and 9 in the same manner as in FIG. 3.

In all three embodiments, in the center area of the inserts, the centerline of the tension member is displaced downward with respect to the centerline 1*a* of the wardrobe rod 1. In FIG. 1, the centerline 3*a* extends in an arc, along a hyperbolic curve, for example. In the embodiment of FIG. 3, the centerline 3*a* of the tension member 3 in the central area of the insert 4' extends completely straight and adjacent to the lower-positioned inner wall of the wardrobe rod 1. In the embodiment of FIG. 4, the centerline 3*a*' of the tension member 3' passes over the entire length of the insert 4" straight and parallel to the centerline 1*a* of the wardrobe rod 1.

The decisive issue in all cases for the effect of the various solutions is the displacement downward, i.e., in the direction of the sag under the influence of its own weight and load, of the tension member 3 or 3' in connection with the lever action that is exerted on the inserts 4 or 4' or 4" by the tensioned tension member, and is transferred via the contact of the insert with the upper inner wall area 1*b*.

Figure 5:
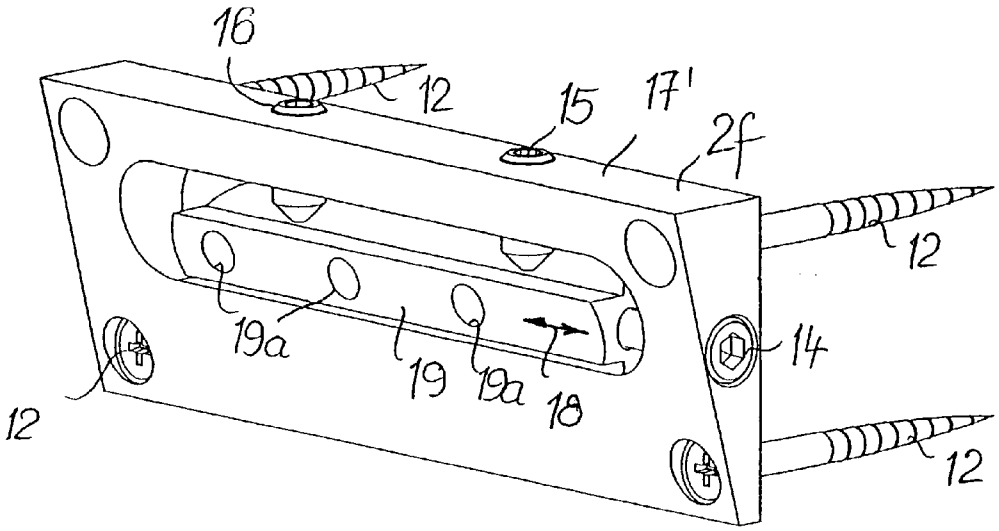
FIG. 5 is a perspective of the lower part of a bracket for attachment to the wall.
Figure 6:
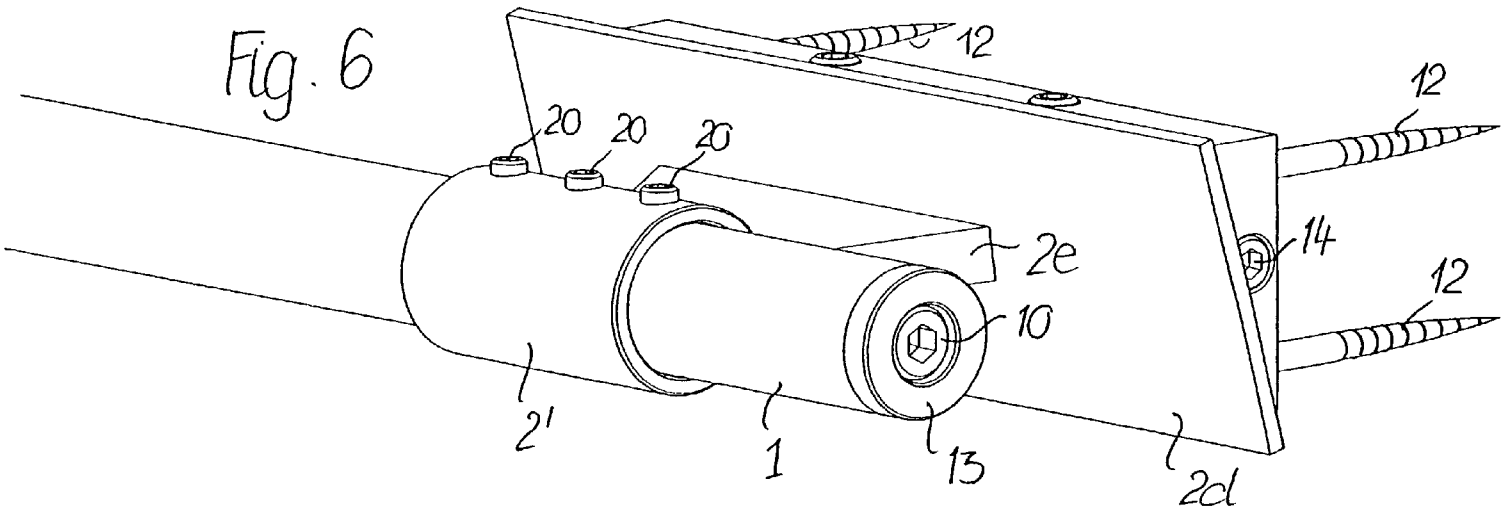
FIG. 6 is a perspective view of the bracket with a wardrobe rod in accordance with the embodiments of FIGS. 3 or 4.

FIGS. 5 and 6 show another tension option for the wardrobe rod. FIG. 5 shows a base plate 17' of a bracket that can be threaded into fixed wall openings such as drywall anchors by means of four attachment screws 12. A bracket element 19 is located in the base plate 17' that may be longitudinally displaced within the base plate 17' in the direction of the double arrow 18. The bracket element 19 includes three countersink holes 19*a* on its front side. Mortises (not visible) of the shoulder 2*e* may engage in these countersink holes to attach the cover plate 2*d*. The shoulder 2*e* is firmly attached to the receiver 2'. The mortises (not shown) of the shoulder 2*e* located on the rear side of the cover plate 2*d*, are so positioned that they engage and fit into the shoulder holes 19*a*. The shoulder 2*e* is held in the engaged position of the shoulders within the shoulder holes 19*a* by means of the bracket element 19 when the securing screws 15 and 16 that transfix the base plate 17' at an angle are tightened.

The bracket 19 may be moved in the direction of the double arrow 18 with the help of the screw 14, depending on rotation direction. Thus, the shoulder 2*e*, the cover plate 2*d*, and the receiver 2' are resultantly moved. The receiver 2' may be connected firmly with the wardrobe rod 1 by means of clamping screws 20.

The described design of the bracket thus allows the application of additional tension by rotating the screw 14, with the result that the progression of the pre-stressed wardrobe rod may be adapted very closely to a straight progression.

Modifications and substitutions by one of ordinary skill in the art are considered to be within the scope of the present invention, which is not to be limited except by the following claims.

What is claimed is:

1. A wardrobe rod comprising:

an elongated tubular rod including a first centerline and defining a cavity having an inner wall;

an insert piece disposed within, and proximate, a center of said cavity of said elongated tubular rod such that a portion of said insert piece contacts said inner wall of said elongated tubular rod, said insert piece having a continuous, longitudinal opening having a contact surface wherein a substantial portion of a center portion of said longitudinal opening is disposed beneath said first centerline; and a tension device for tensioning said elongated tubular rod along a longitudinal direction, wherein said tension device includes a second centerline and a tension member longitudinally transversing said elongated tubular rod such that a portion of said tension member is disposed in said longitudinal opening in contact with said contact surface.

2. The wardrobe rod as in claim 1, wherein said second centerline is displaced in a direction in which said wardrobe rod sags under influence of gravity.

3. The wardrobe rod as in claim 2, wherein the tension member is flexible.

4. The wardrobe rod as in claim 3, wherein the tension member is a cable or tension rod.

5. The wardrobe rod as in claim 4, wherein the elongated tubular rod further includes a central area and an end area, and the tension member further includes an end area, wherein said tension member is displaced at said end area of said tension member and at the end area of the elongated tubular rod in a direction opposite a sag direction in the central area of said elongated tubular rod.

6. The wardrobe rod as in claim 5, wherein the tension member extends in the displaced central area adjacent to the inner wall of the elongated tubular rod.

7. The wardrobe rod as in claim 6, wherein the insert piece lies essentially around and inside the inner wall of the wardrobe rod.

8. The wardrobe rod as in claim 7, wherein the contact surface for a displaced area of the tension member is formed in said longitudinal opening at a circumference of the insert piece.

9. The wardrobe rod as in claim 8, wherein the tension device for the tension member includes a male threaded area that interacts with a female thread.

10. The wardrobe rod as in claim 9, wherein the tension device includes a screw that interacts with the female thread of a tensioning element to which one end of the tension member is attached.

11. The wardrobe rod as in claim 10, wherein the tension device includes an abutment formed by a bracket affixed to the wall.

12. The wardrobe rod as in claim 11, wherein the abutment of the tension device is formed by the rod.

13. The wardrobe rod as in claim 12, wherein the bracket includes a holding arm which is adjustable and fixable along the longitudinal direction of the wardrobe arm.

14. The wardrobe rod as in claim 13, wherein the bracket includes a receiver that surrounds the elongated tubular rod at a first and second end of said elongated tubular rod.

* * * * *